US006361247B1

(12) United States Patent
Detiveaux

(10) Patent No.: US 6,361,247 B1
(45) Date of Patent: Mar. 26, 2002

(54) EROSION CONTROL AND BULKHEAD APPARATUS

(76) Inventor: Carl T. Detiveaux, 4239 Little Bayou Black, Hwy. 311, Houma, LA (US) 70360

( * ) Notice: Subject to any disclaimer, the term of this patent is extended or adjusted under 35 U.S.C. 154(b) by 0 days.

(21) Appl. No.: 09/426,206

(22) Filed: Oct. 25, 1999

(51) Int. Cl.[7] ..... E02B 3/06

(52) U.S. Cl. ..... 405/21; 405/30; 405/31; 405/275; 405/286

(58) Field of Search ..... 405/15, 21, 30, 405/31, 275, 284, 286, 25

(56) References Cited

U.S. PATENT DOCUMENTS

| | | | | | |
|---|---|---|---|---|---|
| 315,384 | A | * | 4/1885 | Boynton | 405/30 |
| 346,140 | A | * | 7/1886 | Bates | 405/21 |
| 1,467,470 | A | | 9/1923 | Borg | |
| 3,733,831 | A | * | 5/1973 | Sticker, Jr. | 405/30 |
| 4,047,389 | A | * | 9/1977 | Yang | 405/25 |
| 4,130,994 | A | | 12/1978 | Van Moss, Jr. | 405/24 |
| 4,498,805 | A | * | 2/1985 | Weir | 405/31 |
| 4,502,816 | A | | 3/1985 | Creter, Jr. et al. | 405/30 |
| 4,715,744 | A | | 12/1987 | Richey | 405/26 |
| 4,767,235 | A | | 8/1988 | Caradonna et al. | 405/33 |
| 4,790,685 | A | | 12/1988 | Scott et al. | 405/30 |
| 4,913,595 | A | | 4/1990 | Creter, Jr. et al. | 405/30 |
| 4,978,247 | A | | 12/1990 | Lenson | 405/15 |
| 5,102,257 | A | | 4/1992 | Creter | 405/25 |
| 5,120,156 | A | * | 6/1992 | Rauch | 405/25 |
| 5,123,780 | A | * | 6/1992 | Martinsen | 405/30 |
| 5,178,489 | A | * | 1/1993 | Suhayda | 405/21 |
| 5,246,307 | A | * | 9/1993 | Rauch | 405/25 |
| 5,259,696 | A | * | 11/1993 | Beardsley | 405/25 |
| 5,393,169 | A | | 2/1995 | Creter | 405/25 |
| 5,441,362 | A | | 8/1995 | Melby et al. | 405/16 |
| 5,507,594 | A | | 4/1996 | Speicher | 405/25 |
| 5,536,112 | A | | 7/1996 | Oertel, II | 405/21 |
| 6,102,616 | A | * | 8/2000 | Foote | 405/21 |

* cited by examiner

*Primary Examiner*—Thomas B. Will
*Assistant Examiner*—Alexandra K. Pechhold

(57) ABSTRACT

An integral concrete body for erosion control includes three separate sections of differing configuration. The sections include a lower tapered section that is in the form of an elongated tapered pile-like member. The upper section of the concrete body is generally rectangular. A transitional section that is also tapered forms a connection between the upper and lower portions of the concrete body. The plurality of the concrete bodies can be installed side by side with tongue and groove connections interlocking the bodies upon assembly. A plurality of the concrete bodies can be placed side by side to form a bulkhead or breakwater. In one embodiment, each concrete body can be comprised of separate connectable members. Anchors can be used to support the concrete bodies laterally, to prevent tilting or tipping when exposed to erosion, wind, or wave action.

16 Claims, 7 Drawing Sheets

EROSION CONTROL AND BULKHEAD APPARATUS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to erosion control and bulkhead systems designed to protect shorelines and to encourage the retention of accretions in order to help build new shorelines. More particularly, the present invention relates to an improved erosion control system and breakwater apparatus that features individual precast concrete members having a lower elongated tapered section, a middle tapered section and a upper generally rectangularly section and wherein conduits that flow through the block from top to bottom can be used to transmit pressurized fluid to the lower and middle tapered sections for jetting away surrounding soil mass during installation of each individual block.

2. General Background of the Invention

The loss of shoreline is a chronic problem in many coastal areas. Wave action can destroy shorelines and adjacent homes or building especially during storm conditions.

One of the often suggested solutions to the problem of coastal erosion control has been the formation of a bulkhead or breakwater in the suspect area.

Bulkheads can take from of elongated networks of pilings, either round or sheet pile type construction. Various systems have been patented that relate generally to erosion control. The following list of patents are examples of systems that are used for bulkheading and/or erosion control at shorelines:

| Patent No. | Title |
|---|---|
| 5,536,112 | Breakwater Generating Apparatus and Process for Controlling Coastal Erosion |
| 5,507,594 | Method and Apparatus for Constructing an Artificial Reef |
| 5,441,362 | Concrete Armor Unit for Protecting Coastal and Hydraulic Structures and Shorelines |
| 5,393,169 | Breakwater |
| 5,246,307 | Submerged Breakwater and Barrier Reef |
| 5,123,780 | Precast Permeable Breakwater Unit |
| 5,102,257 | Breakwater |
| 4,978,247 | Erosion |
| 4,913,595 | Shoreline Breakwater |
| 4,790,685 | Shoreline Breakwater for Coastal Waters |
| 4,767,235 | Prefabricated Composite Element for Building of a Sea Wall |
| 4,715,744 | Floating Breakwater |
| 4,502,816 | Shoreline Breakwater |
| 4,498,805 | Breakwater Module and Means for Protecting a Shoreline Therewith |

-continued

| Patent No. | Title |
|---|---|
| 4,130,994 | Artificial Reef to Prevent Shoreline Erosion |

BRIEF SUMMARY OF THE INVENTION

The present invention provides an improved breakwater apparatus for protecting and building a shoreline. The apparatus includes a concrete body or a plurality of bodies, each having upper and lower end portions. Each concrete body provides front and rear surfaces that are flat and generally parallel in the preferred embodiment. Side surfaces of the concrete body are provided that define a variable width. The concrete body includes three sections. The three sections include a lower pile-like section that can be cylindrical or square or rectangular in transverse cross section and can be tapered. A middle or transitional section is tapered to form an interface between the lower pile-like section and an upper generally rectangular section. The upper section is the widest section of the concrete body and is the portion that is exposed during use.

A flow channel extends between the upper and lower end portions of the body, the flow channel having inlet and outlet openings. The outlet openings define jetting openings for aiding in placement of the concrete bodies during use. The outlet communicates with the lower end portion of the concrete body to provide a jetting means for transmitting fluid under pressure to the lower end portion of the concrete body during installation of the concrete body into a marine sea bed or water bottom.

The apparatus includes preferably a plurality of concrete bodies that extend laterally along a shoreline to be protected. The concrete body includes at least one breakwater opening that extends through the concrete body in between the front and rear surfaces of the concrete body.

In the preferred embodiment, there are a plurality of flow channels that extend from the upper end portion to the lower end portion of the concrete body as an aid to jetting during installation.

The present invention provides a method of erosion control for controlling erosion at a shoreline next to a sea bed and for accumulating accretions that help build shoreline. The method includes the placing of a network of concrete bodies along a shoreline to be protected. Each concrete body provides an internal flow channel.

The method includes the jetting of each of the concrete bodies into a partially embedded position that places a lower end portion of each concrete body in the sea bed using pressurized fluid that flows through flow channels within the concrete body. A plurality of the concrete bodies are closely positioned one adjacent another to form a wall or breakwater.

DETAILED DESCRIPTION OF THE PREFERRED EMBODIMENT

Figure 6:
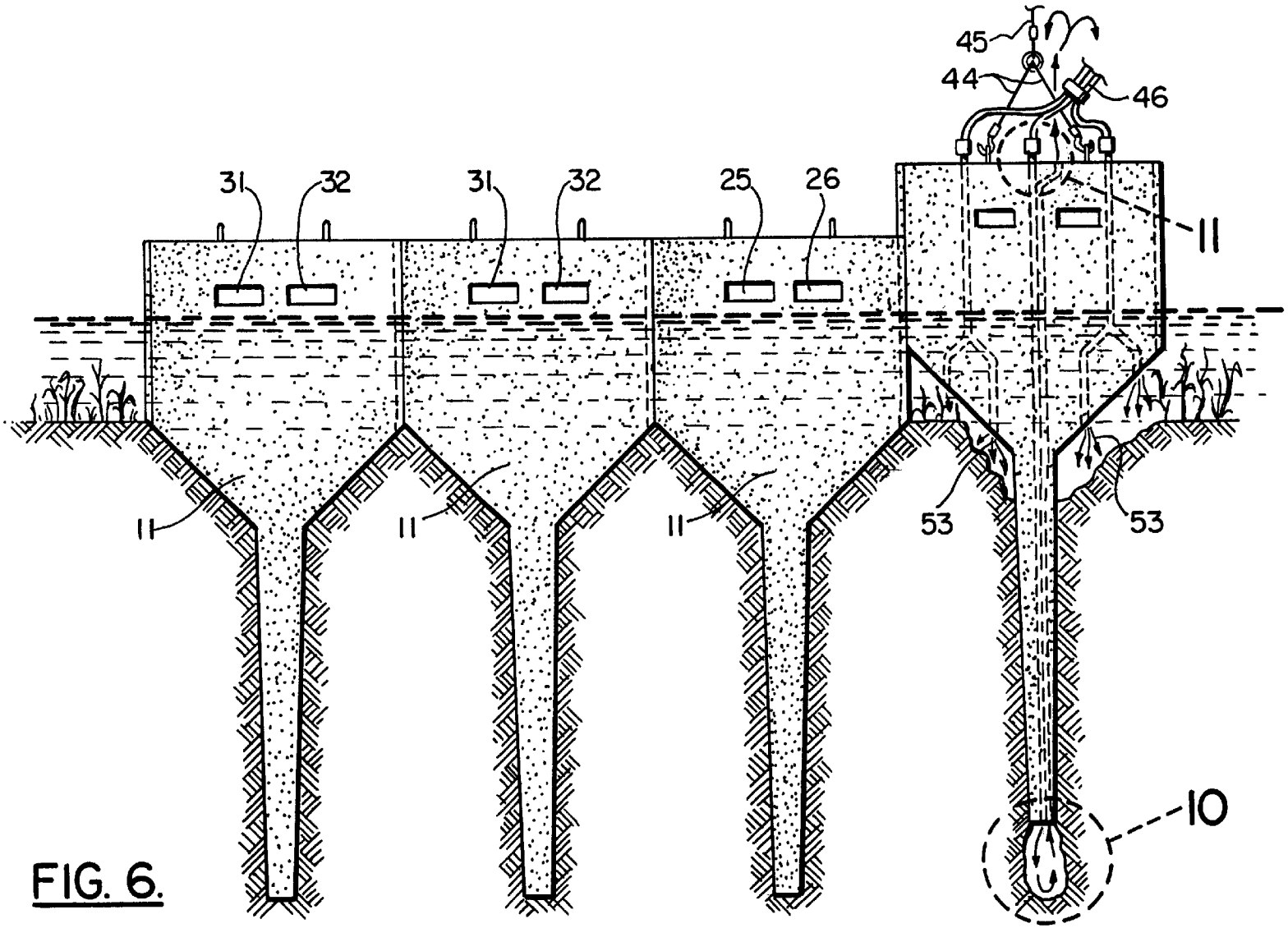
FIG. 6 is an elevational view illustrating the method of installation of the present invention.
Figure 7C:
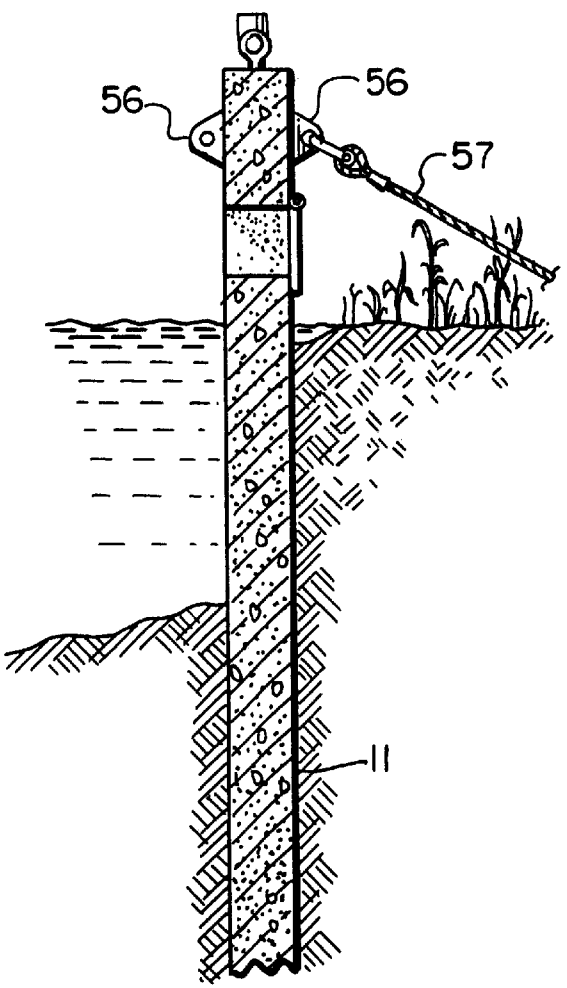
FIGS. 7A, 7B and 7C show the apparatus of the present invention during use and over time during reformation of new shoreline.
Figure 7B:
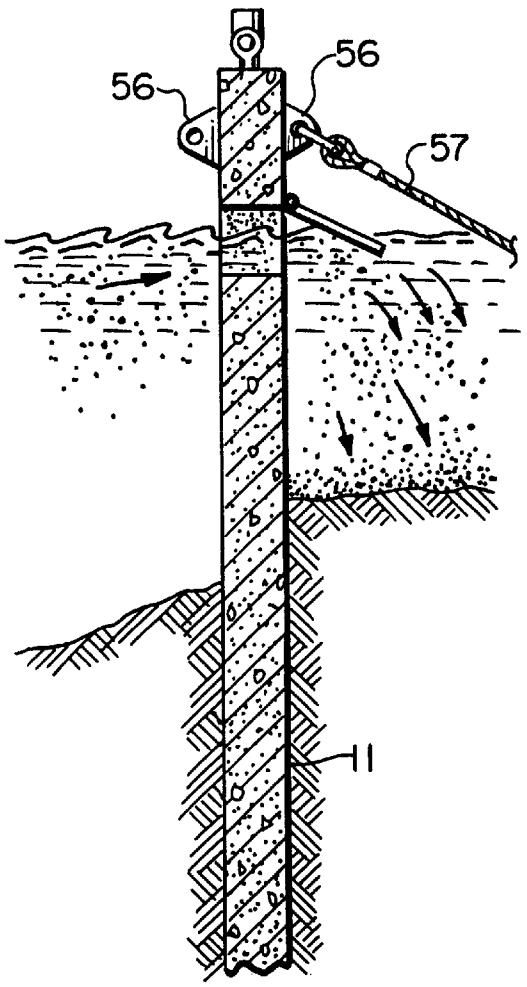
Figure 7A:
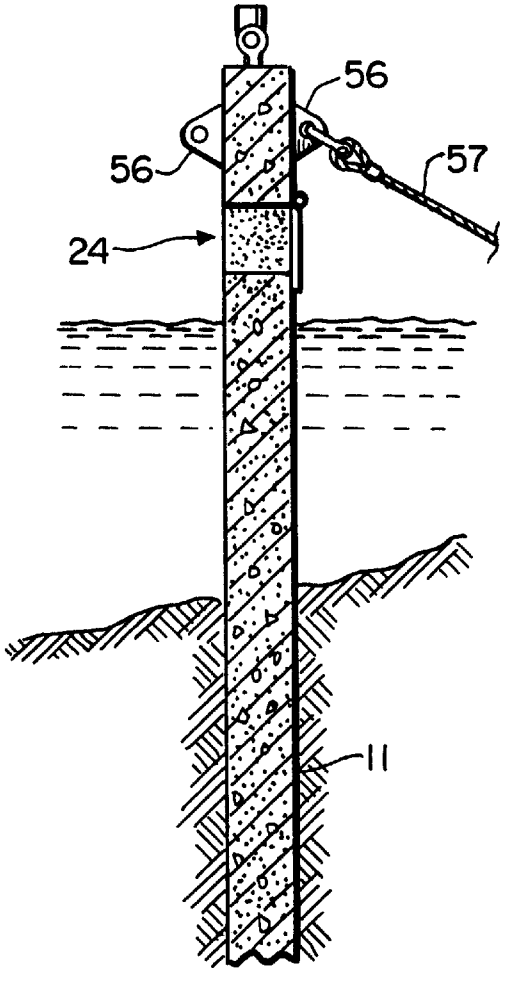
Figure 8:
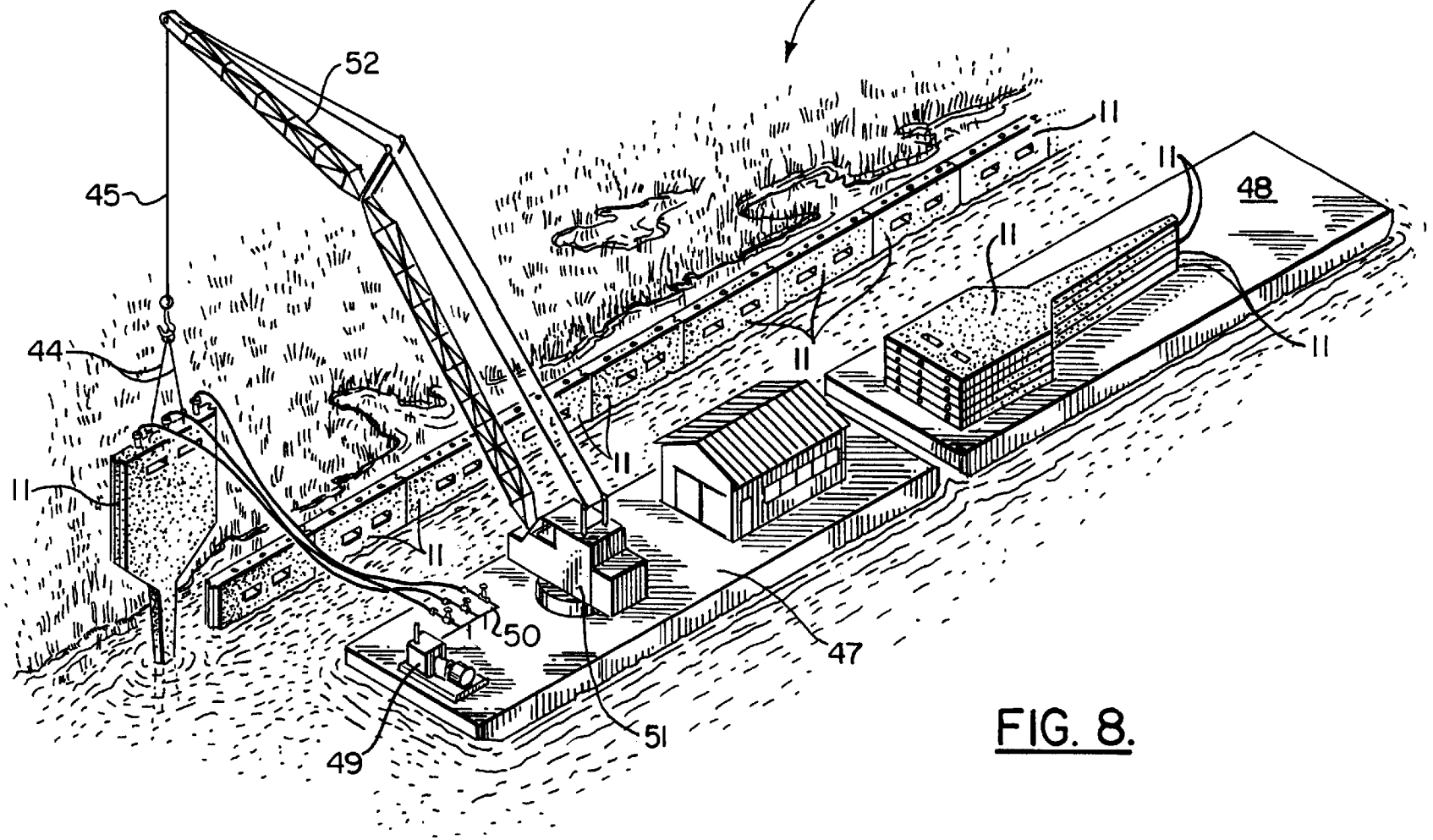
FIG. 8 is perspective view illustrating installation of the apparatus of the present invention using a derrick barge positioned near a shoreline.

Erosion control apparatus 10 is shown generally in FIGS. 6 and 8. The apparatus 10 can be in the form of one or more concrete bodies 11 that are typically placed next to a shoreline to be protected. Concrete body 11 can include three integrally formed sections. These sections 12–14 include a lower pile-like section 12 that can be cylindrical or rectangular in transverse cross section (and preferably tapered), a middle transition section 13 and an upper generally rectangular section 14. The lower section 12 can be tapered to include angled sidewalls 15, 16. The middle section can provide diagonally extending sidewalls 18, 19. The concrete body 11 provides a bottom surface 17 at the lower end of lower tapered section 12 and a flat upper surface 24 at the top of upper rectangular section 14. The upper rectangular section 14 includes generally vertical sidewalls 20 and 21.

Figure 4:
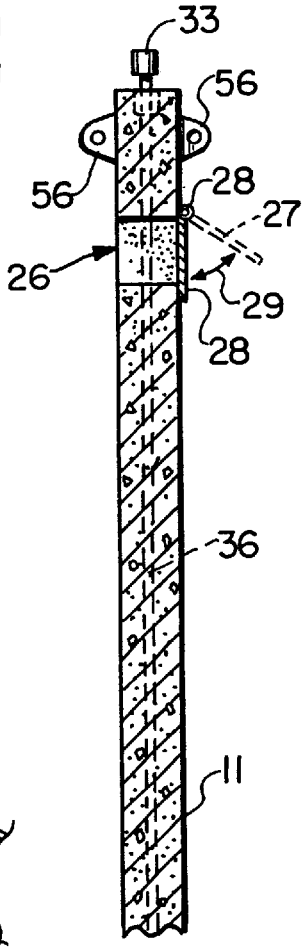
FIG. 4 is a sectional view taken along lines 4—4 of FIG. 1.

Each concrete body 11 has a generally flat front surface 22 and a generally flat rear surface 23. A plurality of openings 25, 26 extend through concrete body 11, each opening 25, 26 communicate between surfaces 22, 23. Each opening 25, 26 is valved with valve plate 27 that can be pivotally attached at hinge 28 to rear surface 23 of body 11 using hinge 28. In FIG. 4, arrow 29 indicates schematically the pivotal movement of valve plate 27 or hinge 28 with respect to body 11 during use.

Figure 9A:
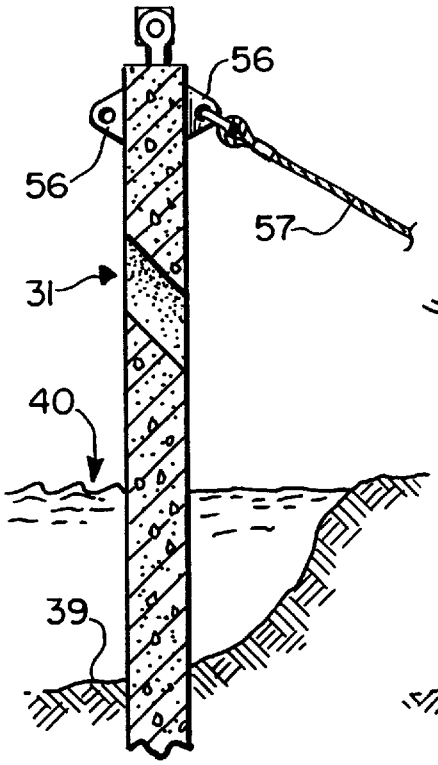
Figure 9B:
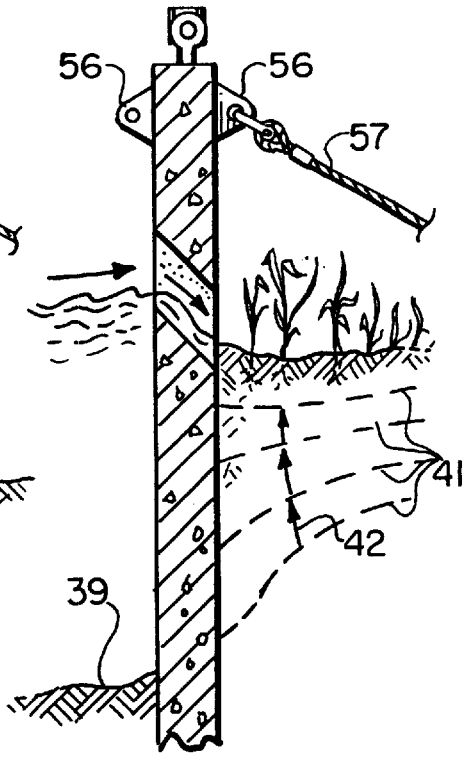

Each concrete body 11 can be lifted during installation using a crane 51 (see FIG. 8) or like lifting apparatus. One or more lifting eyes 30 can be provided on the body 11, such as, for example at upper surface 24 as shown in FIGS. 1, 4, 9A, 9B. In FIGS. 9A and 9B, the openings that communicate between the front surface 22 and rear surface 23 of concrete body 11 can alternatively be diagonal openings 31, 32.

In FIGS. 6 and 8, a concrete body 11 is shown being lifted by a crane 51 having boom 52 and crane lift line 45. The crane 51 can be part of a larger lifting apparatus used in the marine environment such as a derrick barge 47. The derrick barge 47 can carry a plurality of concrete bodies 11. Alternatively, a separate supply barge 48 can be provided carrying a plurality of concrete bodies 11 in order to create a bulkhead as shown in FIGS. 6 and 8. In FIG. 6, crane lift line 45 is shown attached to bridle 44. The bridle 44 connects to a pair of spaced apart lifting eyes 30.

In order to install one or more of the concrete bodies 11, a jetting arrangement has been provided that enables fluid to be pumped through each concrete body 11 during installation. When a concrete body 11 has been lifted by crane 51 and positioned in a desired location as shown in FIG. 8, pumps 49 and manifold 50 on derrick barge 47 can be used to pump fluid under pressure through the hoses of hose bundle 47 to the plurality of inlet fittings 33. Fluid inlet fittings 33 can be placed on the flat upper surface 24 of each concrete body 11. The fluid inlet fittings 33 preferably are quick release type fittings that enable the hoses of hose bundle 46 to be connected and disconnected quickly to a particular concrete body 11 during installation. Once the hose bundle 46 is connected to inlet fittings 33, a series of flow channels is provided internally of concrete body 11 for channeling flow to a number of different flat surfaces of concrete body 11. In the preferred embodiment, these surfaces include bottom surface 17, and the two diagonally extending surfaces 18, of middle tapered section 13. An outlet 35 is provided each of the surfaces 17, 18, 19 where a flow channel communicates with the surface 17, 18, or 19.

Figure 1:
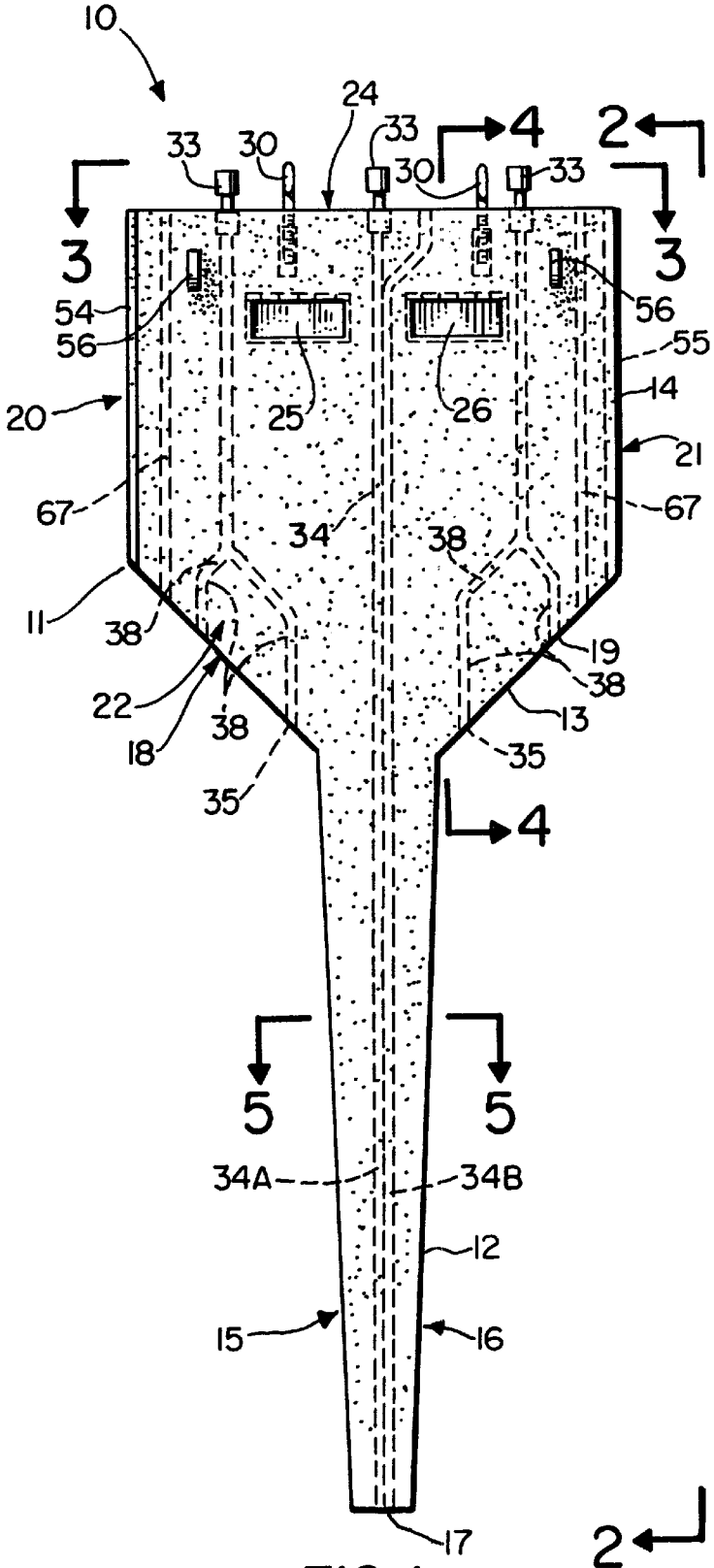
FIG. 1 is a front elevational view of the preferred embodiment of the apparatus of the present invention.
Figure 2:
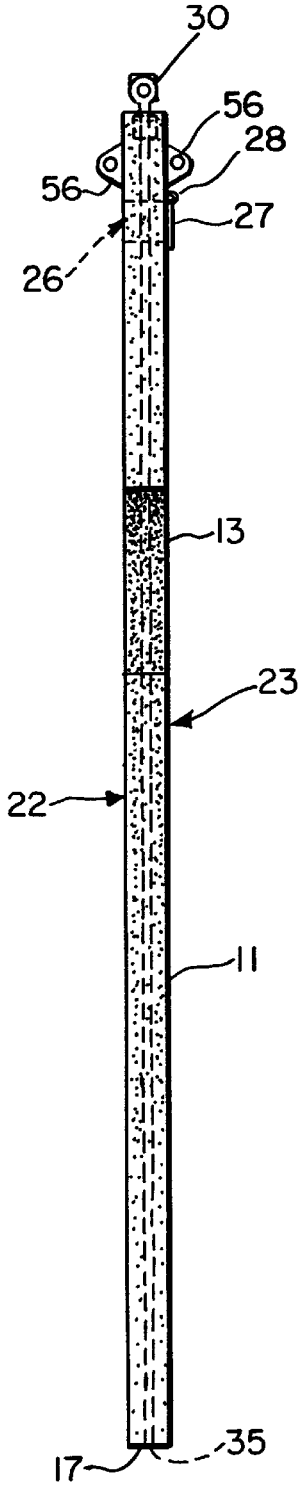
FIG. 2 is a sectional view taken along lines 2—2 of FIG. 1.
Figure 3:
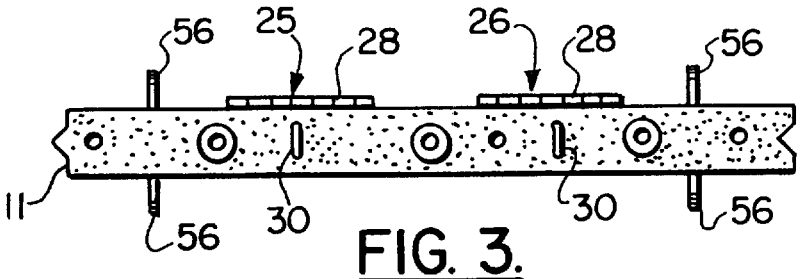
FIG. 3 is a sectional view taken along lines 3—3 of FIG. 1.
Figure 5:
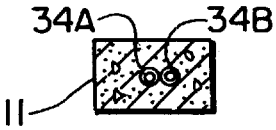
FIG. 5 is a sectional view taken along lines 5—5 of FIG. 1.
Figure 10:
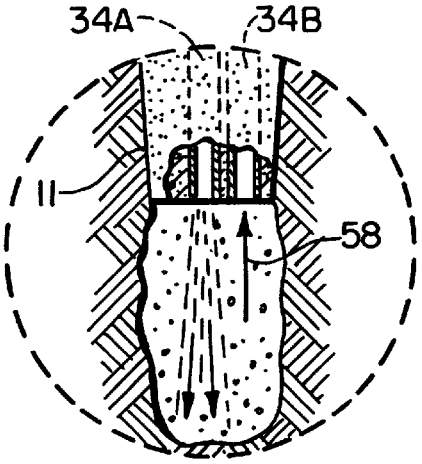
FIG. 10 is a fragmentary view of the preferred embodiment of the apparatus of the present invention showing the lower tip of the apparatus during jetting.
Figure 11:
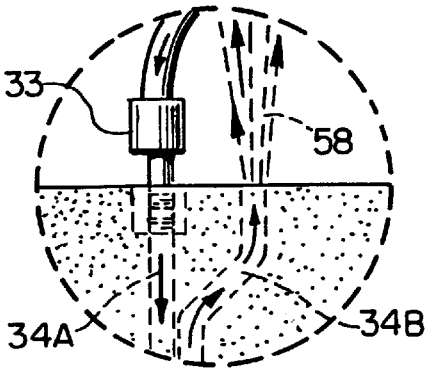
FIG. 11 is a fragmentary view of the preferred embodiment of the apparatus of the present invention showing return flow during jetting.

In FIGS. 1 and 2, the plurality of flow channels can include, for example, a central flow channel 34A, a pair of lateral flow channels 36, and branch channels 38. There can be a return flow path for each flow channel, such as return channel 34B that is positioned next to flow channel 34A. In some situations, it may be necessary to return flow during jetting, as shown by arrows 58 in FIGS. 10–11. The branch channels 38 communicate with wye 37 as shown in FIG. 1. Whereas three inlet fittings 33 are provided in the drawings for adding fluid under pressure to the channels of concrete body 11, five different outlets 35 are provided in the drawings for jetting purposes at bottom surface 17 and at diagonally extending side surfaces 18, 19. These are examples of the number of inlets 33, channels 34 and outlets 35.

During installation, fluid is pumped under pressure through hose bundle 46 to inlet fittings 33 and then into channels 34, 36, 38 as shown in FIG. 6. Arrows 53 in FIG. 6 schematically indicate the direction of fluid flow during installation. This aforedescribed jetting arrangement enables soil to be chewed away from the area to be occupied by a concrete body 11 as shown in FIG. 6.

Each of the concrete bodies 11 provides a tongue and groove interlocking connection for connecting a plurality of the bodies 11 together as shown in FIG. 6. In FIG. 1, a tongue portion 54 is shown extending vertically along side 20. A groove 55 is shown communicating with vertical sidewall 21. Tongue 54 and groove 55 provide an interlocking connection between the generally vertical sidewalls 20, 21 of adjacent concrete bodies 11 as shown in FIG. 6.

In each of the FIGS. 1–4 and 6–7, a cable anchor can be used to restrain each concrete body 11 from lateral movement during use. The cable anchor can be in the form of a padeye 56 mounted at the upper end portion of each concrete body 11. If desired, padeyes 56 can be placed on both sides, 22 and 23 as shown in FIG. 2 and at spaced apart locations as shown in FIG. 1. Each padeye can have one or more cable anchors 57 attached thereto. Each cable anchor 57 can be of wire rope, for example, and attached to a suitable anchor in the surrounding earth such as for example, piling or a group of piling (not shown).

Figure 12:
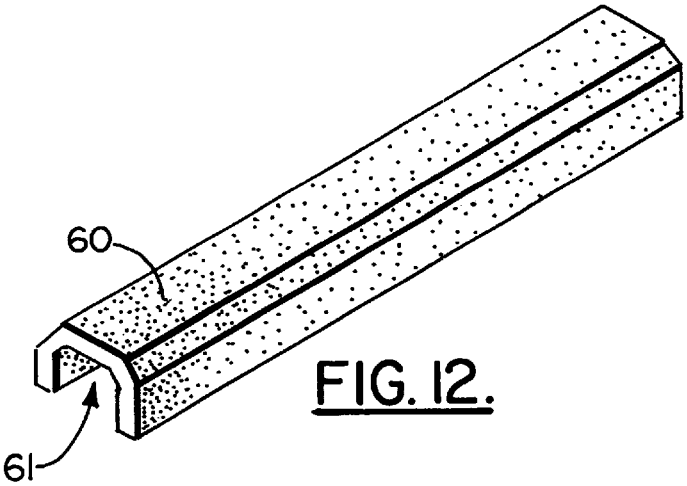
FIG. 12 is a fragmentary view of the preferred embodiment of the apparatus of the present invention showing the horizontal connecting beam.
Figure 13:
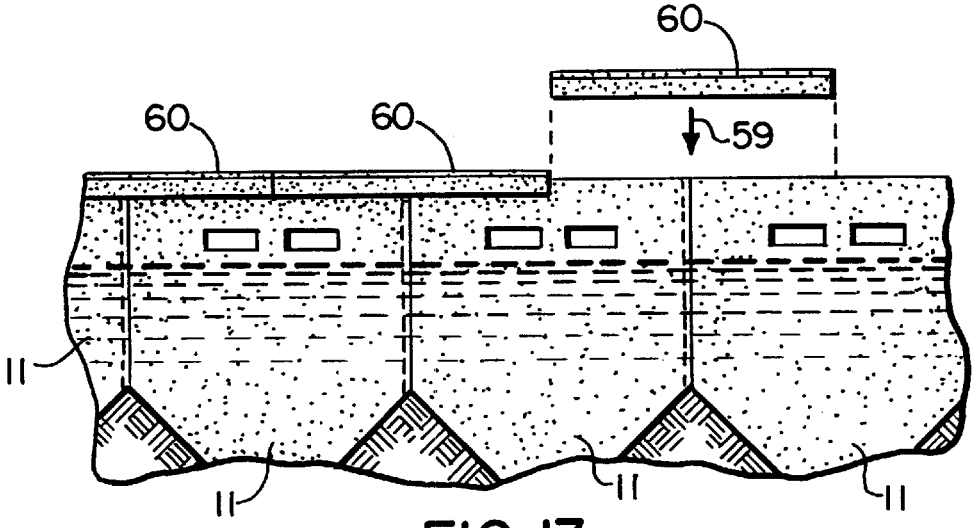
FIG. 13 is an elevational view of the preferred embodiment of the apparatus of the present invention showing installation of the cover beam.

FIGS. 12 and 13 shown a beam 60 that can be used to form a cap or cover to align a plurality of concrete bodies 11 as shown in FIG. 13. Beam 60 provides a recess 61 that fits the upper end portion of each concrete body 11. The beam 60 can be placed at intervals as shown by arrow 59 in FIG. 13.

Figure 14:
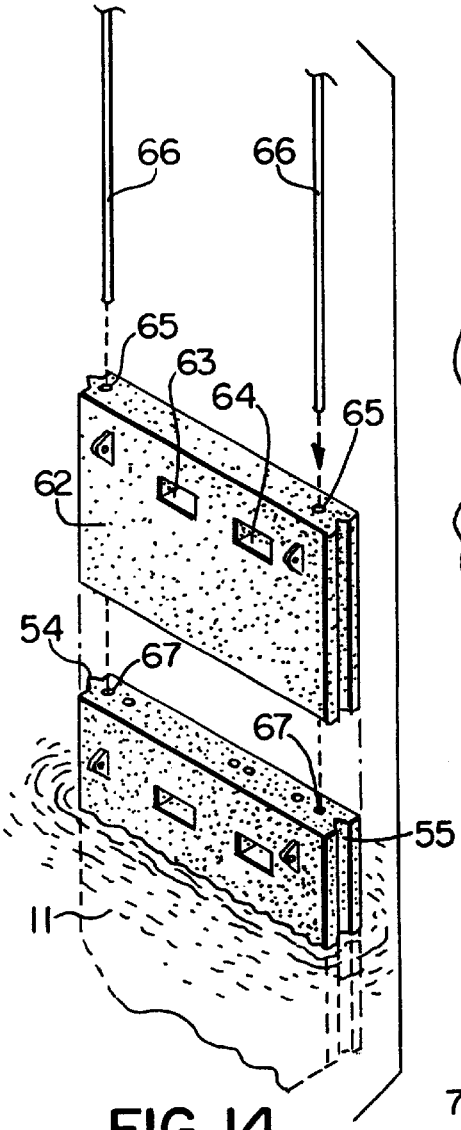
FIG. 14 is a perspective view of a second embodiment of the apparatus of the present invention.

In FIG. 14, an extension 62 is shown for increasing the overall height of a concrete body 11. Extension 62 provides one or more openings 63 through which water can flow carrying sand or other solid material that will aid in the build up of shoreline. As with the concrete body of FIGS. 1–3 and 9A–9B, the openings can be either straight and linear or diagonally extending as shown in FIG. 9A. For purposes of illustration, extension 62 provides left and right openings 63, 64. A pair of spaced apart vertical rod openings 65 are provided, each receiving a rod 66. Similarly, vertical openings are provided in concrete body 11 for receiving the lower end portion of a rod 66. Vertical openings 67 are receptive or rods 66 as shown in FIGS. 1 and 14.

Figure 15:
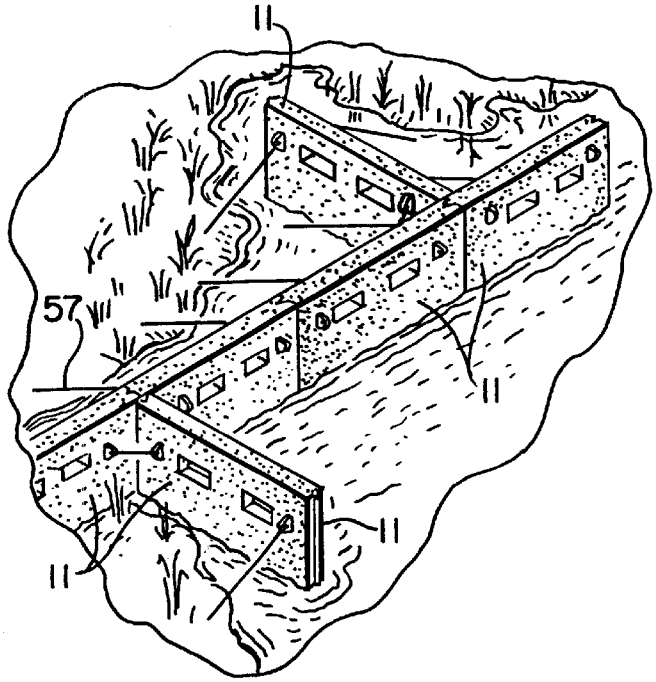
FIG. 15 is a perspective view of the preferred embodiment of the apparatus of the present invention showing a network of perpendicularly arranged concrete bodies.

In FIG. 15, concrete bodies 11 are shown in position wherein some of the concrete bodies form an angle with other concrete bodies. For example, a concrete body can be placed perpendicular to other concrete bodies 11. In 15 as an example, two concrete bodies 11 are shown placed perpendicular to a plurality of four other concrete bodies. In placing such a perpendicularly oriented concrete body 11, the perpendicular body 11 is preferably placed at the tongue and groove 54, 55 joint as shown.

Figure 16:
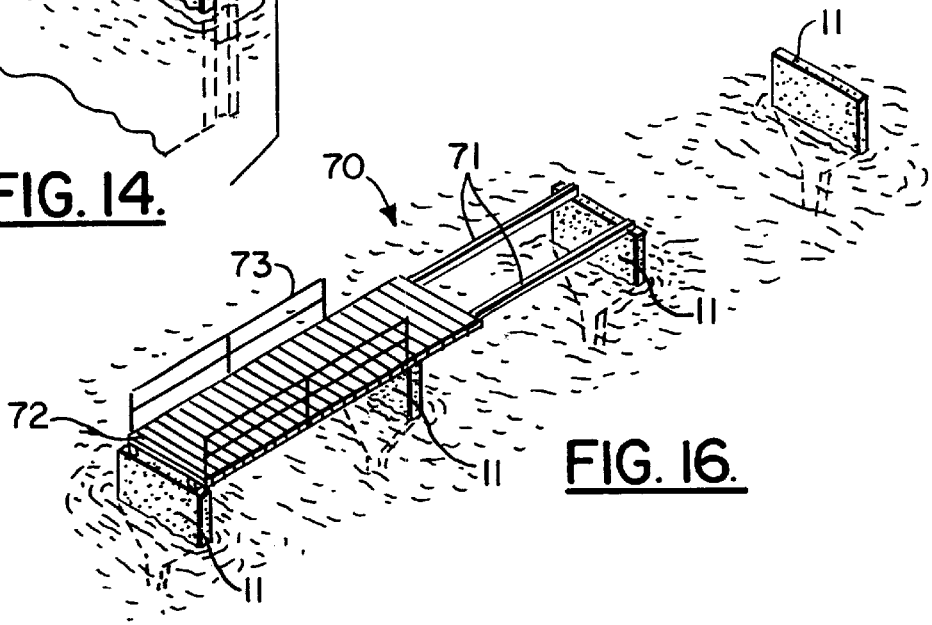
FIG. 16 is a perspective view of a third embodiment of the apparatus of the present invention in the form of a pier or wharf.

In FIG. 16, the concrete bodies 11 are shown in a spaced apart position for the purpose of supporting a pier 70. Pier 70 as shown in FIG. 16 during construction, including four spaced apart concrete bodies 11, a pair of longitudinal beams 71, and decking 72. Hand rails 73 can optionally be provided to decking 72 in order to complete pier 70.

The foregoing embodiments are presented by way of example only; the scope of the present invention is to be limited only by the following claims.

What is claimed is:

1. A breakwater apparatus for protecting a shoreline next to a marine environment that has a seabed and sea water above the seabed, comprising:

a) a plurality of concrete bodies, each having upper and lower sections, front and rear surfaces and side surfaces, the upper section being much wider between the side surfaces than the lower section, a middle transition section that is in between the upper section and the lower section, the middle section having laterally extending surfaces that extend between the top of the lower section and the bottom of the upper section, the bodies being positioned side to side with their respective side surfaces abutting and extending in a line along the shoreline to be protected;

b) an uninterrupted flow channel water jetting system that extends uninterrupted between the upper and lower end portions of the body and to the laterally extending surfaces of the middle section, the flow channel system having inlet and multiple outlet water jetting openings and being uninterrupted between the inlet and outlet openings;

c) the outlet openings communicating with the lower end portion of the concrete body and the laterally extending surfaces of the middle section to define a jetting means for transmitting fluid under pressure to the lower end portion of the concrete body and to the middle section of the concrete body during installation of the concrete body into the seabed.

2. The breakwater apparatus of claim 1 further comprising at least one breakwater opening that extends through a plurality of the concrete bodies in between the front and rear surfaces of the concrete body.

3. The breakwater apparatus of claim 2 wherein there are a plurality of said flow channels.

4. The breakwater apparatus of claim 2 wherein there are a plurality of said breakwater openings in each concrete body.

5. The breakwater apparatus of claim 2 wherein the breakwater opening extends diagonally between the front and rear surfaces of the concrete body.

6. The breakwater apparatus of claim 1 wherein the lower end portion of the concrete body is tapered.

7. The breakwater apparatus of claim 1 wherein each concrete body side surface includes a part that fits against a side surface of an adjacent concrete body during use.

8. The breakwater apparatus of claim 1 wherein the concrete body has an upper surface, and wherein the inlet openings are on the upper surface.

9. The breakwater apparatus of claim 1 wherein the concrete body is comprised of separate, connectable sections.

10. A method of erosion control for controlling erosion at a shoreline next to a seabed with sea water above it, comprising the steps of:

a) placing a network of concrete bodies along a shoreline to be protected from erosion and generally in line with the shoreline, each concrete body having;

i) upper and lower sections, front and rear surfaces and side surfaces, the upper section being much wider between the side surfaces than the width of the lower section, ii) each concrete body having a tapered middle portion that defines a transition section that is in between the upper section and the lower section, iii) an internal flow channel that extends uninterrupted between the upper and lower end portions of the body and to the laterally extending surfaces of the middle section, the flow channel system having inlet and multiple outlet water jetting openings and being uninterrupted between the inlet and outlet openings;

iv) a plurality of jetting outlets;

b) jetting each of the concrete bodies into a partially embedded position with pressurized fluid that flows uninterrupted through the flow channel, said jetting placing the lower section of each concrete body in the seabed and the transition section next to the seabed;

c) wherein each concrete body is closely positioned to an adjacent concrete body;

d) communicating the flow channel in step "a" with each jetting outlet at the lower section of the concrete body, and in step "b" the jetting includes pumping fluid under pressure through the uninterrupted flow channel to each jetting outlet.

11. The method of claim 10 further comprising the step of providing a breakwater opening through the concrete body through which water can flow.

12. The method of claim 10 wherein the concrete body includes a larger upper end portion that has a pair of diagonally extending surfaces and further comprising the step of jetting the diagonally extending surfaces during installation.

13. The method of claim 10 wherein the concrete body includes a larger upper end portion that has a pair of diagonally extending surfaces, and flow channels through the concrete body communicating with jetting outlets at the diagonally extending surfaces, and further comprising the step of jetting the diagonally extending surfaces at the jetting outlets during installation.

14. The method of claim 10 wherein each concrete body includes a lower tapered section, a middle tapered section having opposed diagonally extending surfaces, and an upper section, wherein the volume of the upper and middle sections is greater than the lower section, and further comprising the step of embedding at least the lower tapered section and middle section in the seabed, wherein the upper section has at least one flow opening therethrough and further comprising the step of allowing wave action to push water and accretions through the flow opening.

15. A method of erosion control for controlling erosion at a shoreline next to a seabed, comprising the steps of:

a) placing a network of concrete bodies along a shoreline to be protected from erosion, each of the concrete bodies having a lower end portion with a smaller cross section, a middle tapered section, and an upper end portion with a larger cross section;

b) partially embedding each concrete body into the seabed in a position that places the lower end portion of each concrete body in the seabed and the middle tapered section next to the seabed, the upper end portion being an exposed portion of the concrete body that extends above the seabed and next to the waterline;

c) wherein each concrete body is closely positioned to an adjacent concrete body;

d) using a flow channel in each concrete body to pump fluid under pressure through the concrete body and externally thereof to aid in the embedding of step "b", the flow channel extending uninterrupted between the upper and lower end portions of the body and to the laterally extending surfaces of the middle section, the flow channel system having inlet and multiple outlet water jetting openings and being uninterrupted between the inlet and outlet openings; and e) laterally restraining the concrete body.

16. The method of claim 15 wherein step "b" comprises laterally restraining the concrete body with an elongated anchor that is anchored in an adjacent soil mass.

* * * * *